US008096792B2

(12) United States Patent
Suefuji et al.

(10) Patent No.: US 8,096,792 B2
(45) Date of Patent: Jan. 17, 2012

(54) SCROLL TYPE FLUID MACHINE WITH A ROTATION PREVENTING CYLINDRICAL MEMBER

(75) Inventors: Kazutaka Suefuji, Kanagawa (JP); Yuji Komai, Tokyo (JP); Susumu Sakamoto, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 572 days.

(21) Appl. No.: 12/285,038

(22) Filed: Sep. 29, 2008

(65) Prior Publication Data

US 2009/0110580 A1 Apr. 30, 2009

(30) Foreign Application Priority Data

Oct. 31, 2007 (JP) ..... 2007-284279

(51) Int. Cl.
*F03C 2/00* (2006.01)
*F03C 4/00* (2006.01)
*F04C 18/00* (2006.01)

(52) U.S. Cl. ..... 418/55.3; 418/55.5; 418/57; 418/152; 464/103

(58) Field of Classification Search ..... 418/55.1–55.6, 418/57, 152, 154, 155; 464/102, 103
See application file for complete search history.

(56) References Cited

U.S. PATENT DOCUMENTS 4,474,543 A * 10/1984 Hiraga et al. ..... 418/55.3
6,152,712 A * 11/2000 Ueda ..... 418/55.3
7,455,508 B2 * 11/2008 Suefuji et al. ..... 418/55.1

FOREIGN PATENT DOCUMENTS

JP 2003065259 A * 3/2003
JP 2003-322149 A 11/2003
JP 2006283673 A * 10/2006

OTHER PUBLICATIONS

JP 2003035259 A Komai et al. Mar. 5, 2003—English Translation.*

* cited by examiner

*Primary Examiner* — Theresa Trieu
(74) *Attorney, Agent, or Firm* — Crowell & Moring LLP

(57) ABSTRACT

The present invention provides a scroll type fluid machine realizing reduced attachment space in a casing and improvement in workability at the time of assembly and the like by using a plurality of ball coupling mechanisms. A plurality of ball coupling mechanisms are disposed between a casing and a rear side of an orbiting scroll. Each of the ball coupling mechanisms includes first and second thrust receivers (reception plates), a sphere, and a cylindrical ring. A thrust load to be applied to an end plate of the orbiting scroll is received between the first and second thrust receivers (reception plates) and the sphere. The cylindrical ring disposed between the first and second thrust receivers displays a so-called rotation preventing effect in such a manner that its outer peripheral surface makes a rolling contact with inner peripheral surfaces of cylindrical portions in association with an orbiting motion of the orbiting scroll.

20 Claims, 11 Drawing Sheets

SCROLL TYPE FLUID MACHINE WITH A ROTATION PREVENTING CYLINDRICAL MEMBER

BACKGROUND OF THE INVENTION

1. Field of the Invention

The present invention relates to scroll type fluid machinery suitable to be used in air compressors, vacuum pumps, and the like.

2. Description of the Related Art

In general, one of known scroll type fluid machinery is, for example, a scroll type compressor for continuously compressing fluid such as air in a compression chamber between an orbiting scroll and a fixed scroll by driving the orbiting scroll to orbit relative to the fixed scroll by a driving source such as an electric motor (refer to, for example, Japanese Patent Application Laid-Open No. 2003-322149).

A conventional scroll type compressor of this kind comprises a cylindrical casing, a fixed scroll fixed to the casing and having a spiral wrap portion extending from an end plate, an orbiting scroll opposed to the fixed scroll, orbitably provided in the casing, and having a spiral wrap portion extending from an end plate and overlapping the wrap portion of the fixed scroll, thereby defining a plurality of compression chambers; and an eccentric thrust bearing provided between the rear side of the orbiting scroll and the casing to prevent rotation of the orbiting scroll and to receive a thrust load.

In the conventional technique, however, by the eccentric thrust bearing provided between the rear side of the orbiting scroll and the casing, a thrust load from the orbiting scroll can be received on the casing side and rotation of the orbiting scroll can be also prevented. However, the eccentric thrust bearing has a large-diameter shape and structure extending over the entire periphery on the rear side of the orbiting scroll. This leads to large occupation area (attachment space) in the casing and law workability at the time of assembly.

The present invention has been made in view of the above-mentioned conventional art problems, and an object of the present invention is to provide a scroll fluid machine using a plurality of ball coupling mechanisms, thereby realizing smaller attachment space in a casing and improved workability at the time of assembly, smoothly preventing rotation of an orbiting scroll, and capable of receiving a thrust load.

SUMMARY OF THE INVENTION

In order to solve the above problems, a configuration employed by the present invention is featured in that at least two ball coupling mechanisms out of at least three ball coupling mechanisms provided between an orbiting scroll side and a fixed-side member side comprises: a sphere rotatably provided between the fixed-side member side and the orbiting scroll side and receiving a thrust load applied to the orbiting scroll; and a rotation preventing cylindrical member provided between the fixed-side member and the orbiting scroll so as to surround the sphere from the outside in the radial direction to prevent rotation of the orbiting scroll by making a rolling contact with the fixed-side member side and the orbiting scroll side.

Another configuration employed by the present invention is featured in that at least two of respective ball coupling mechanisms comprises: a first thrust receiver taking the form of a bottomed cylindrical member provided on the casing in a position opposed to a rear side of the orbiting scroll, whose one side in the axial direction opens to form a cylindrical portion, and whose other side closes to be a bottom portion; a second thrust receiver taking the form of a bottomed cylindrical member provided on the rear side of the orbiting scroll opposed to the first thrust receiver in the axial direction, whose one side in the axial direction is closed to be a bottom portion, and whose the other side opens, facing the first thrust receiver, to form a cylindrical portion; a sphere rotatably provided between the bottom portion side of the first thrust receiver and the bottom portion side of the second thrust receiver and receiving a thrust load applied to the orbiting scroll in cooperation with the first and second thrust receivers; and a rotation preventing cylindrical member positioned between the first and second thrust receivers, provided so as to surround the sphere from outside in the radial direction to prevent rotation of the orbiting scroll by making a rolling contact with an inner peripheral side of a cylindrical portion in the first thrust receiver and with an inner peripheral side of a cylindrical portion in the second thrust receiver.

Still another configuration employed by the present invention is featured in that at least two of respective ball coupling mechanisms comprises: a first thrust receiver taking the form of a bottomed cylindrical member provided on the casing in a position facing a rear side of the orbiting scroll, whose one side in the axial direction opens to form a cylindrical portion, and whose other side closes to be a bottom portion; a second thrust receiver taking the form of a bottomed cylindrical member provided on the rear side of the orbiting scroll so as to face the first thrust receiver in the axial direction, whose one side in the axial direction closes to be a bottom portion, and whose the other side opens, facing the first thrust receiver, to form a cylindrical portion; a sphere rotatably provided between the bottom portion side of the first thrust receiver and the bottom portion side of the second thrust receiver for receiving a thrust load applied to the orbiting scroll in cooperation with the first and second thrust receivers; and a rotation preventing cylindrical member positioned between the first and second thrust receivers, provided so as to surround the sphere from outside in the radial direction, to prevent rotation of the orbiting scroll by making a rolling contact with an outer peripheral side of a cylindrical portion in the first thrust receiver and with an outer peripheral side of a cylindrical portion in the second thrust receiver.

Still another configuration employed by the present invention is featured in that at least two of respective ball coupling mechanisms comprises: a sphere rotatably provided between the casing side and an orbiting scroll side and for receiving a thrust load applied to the orbiting scroll; and a rotation preventing cylindrical member whose both ends in the axial direction are fixed to the casing side and the orbiting scroll side, respectively, in a state where the sphere is surrounded from outside in the radial direction, and whose deformation in the axial direction is regulated while whose deformation in the radial direction is permitted, thereby preventing rotation of the orbiting scroll.

As described above, according to the present invention, at least two of the ball coupling mechanisms comprises: a sphere for receiving a thrust load applied to the orbiting scroll; and a rotation preventing cylindrical member positioned between a fixed-side member (casing or fixed scroll) side and an orbiting scroll side so as to surround the sphere from outside in the radial direction to prevent rotation of the orbiting scroll by making a rolling contact with the fixed-side member side and the orbiting scroll side. By using such ball coupling mechanisms, the attachment space in the casing can be reduced, and workability at the time of assembly can be improved. Moreover, rotation of the orbiting scroll can be smoothly prevented and the thrust load acting on the orbiting scroll can be received well.

DESCRIPTION OF THE PREFERRED EMBODIMENTS

The cases of applying a scroll type fluid machine as embodiments of the present invention to an oilless air compressor will be described in detail with reference to the attached drawings.

Figure 1:
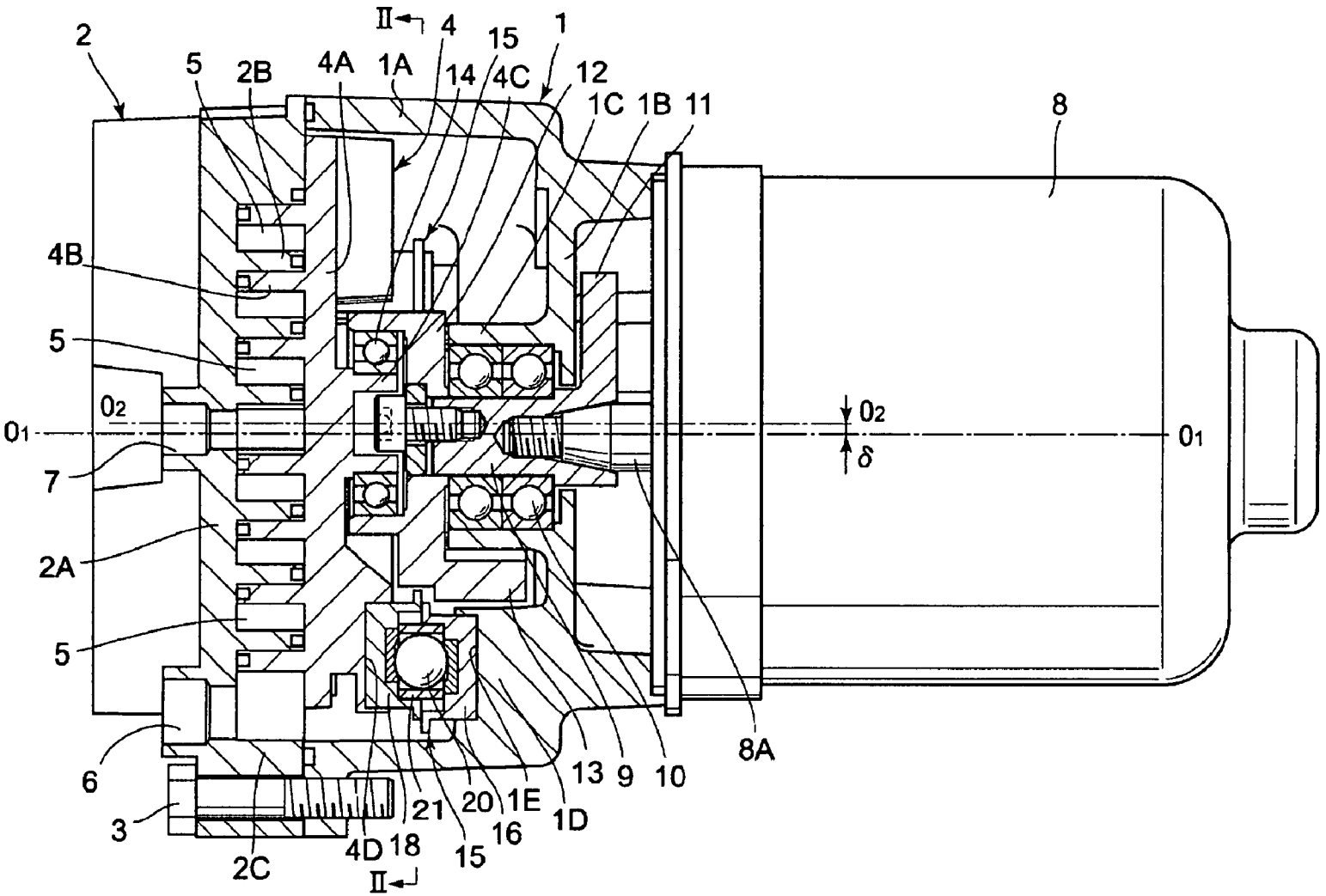
FIG. 1 is a longitudinal sectional view showing a scroll type air compressor according to a first embodiment of the present invention.

FIGS. 1 to 6 show a first embodiment of the present invention. In the drawings, reference numeral 1 denotes a casing forming an outer shell of an air compressor (scroll type fluid machine). The casing 1 extends in the axial direction along an axis O1-O1 as shown in FIG. 1 and formed as a bottomed cylindrical body whose one end in the axial direction is open. A fixed-side member is formed by the casing 1 and a fixed scroll 2 which will be described later. An electric motor 8 having an output shaft 8A which will be described later along the axis O1-O1 is detachably attached to the other end in the axial direction of the casing 1.

In this case, the casing 1 is constructed by, roughly, a cylindrical portion 1A having an axially open one end (opened toward the fixed scroll 2 which will be described later), an annular bottom portion 1B formed integrally on the other side in the axial direction of the cylindrical portion 1A and extending internally in the radial direction, and a cylindrical bearing attachment portion 1C protruded from the inner peripheral side of the bottom portion 1B toward one side in the axial direction. In the cylindrical portion 1A of the casing 1, there housed are an orbiting scroll 4 which will be described later, an eccentric bush 12, a balance weight 13, a ball coupling mechanism 15, and the like.

On the bottom portion 1B side of the casing 1, a plurality of (for example, three) seat portions 1D for receiving a thrust load in the axial direction, to be applied to the orbiting scroll 4 which will be described later via the ball coupling mechanism 15 are provided. The seat portions 1D are disposed at predetermined intervals in the circumferential direction of the casing 1. In each of the seat portions 1D, an attachment recess 1E in which a thrust receiver 16 of the ball coupling mechanism 15 to be described later is fit and attached is formed.

Reference numeral 2 denotes the fixed scroll fixed at the open end of the casing 1 (cylindrical portion 1A). As shown in FIG. 1, the fixed scroll 2 has, roughly, a disk-like end plate 2A formed around an axis O1-O1 as a center, a spiral wrap portion 2B provided upright on the surface of the end plate 2A, and a cylindrical support portion 2C provided at an outer peripheral side of the end plate 2A encircling the wrap portion 2B and secured to the open end side of the casing 1 (cylindrical portion 1A) by a plurality of bolts 3 and the like.

Figure 2:
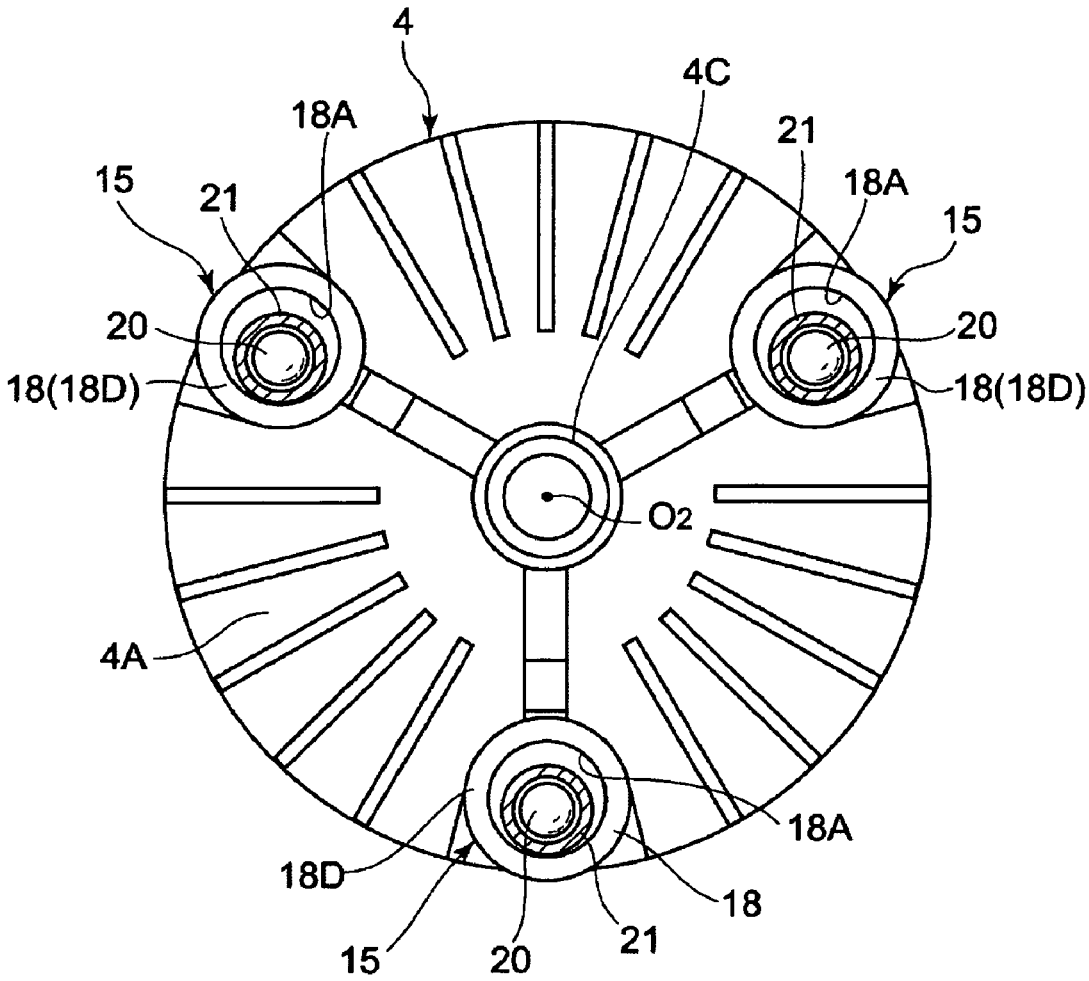
FIG. 2 is a sectional view taken along II-II of FIG. 1, of an orbiting scroll and a ball coupling mechanism.

Reference numeral 4 denotes the orbiting scroll orbitably provided in the casing 1 in a position opposed to the fixed scroll 2 in the axial direction. As shown in FIGS. 1 and 2, the orbiting scroll 4 is constructed by, roughly, a disk-like end plate 4A formed around an axis O2-O2 as a center, a spiral wrap portion 4B provided upright on the surface of the end plate 4A, and a cylindrical boss portion 4C protruded to the rear face (the face opposite to the wrap portion 4B) side of the end plate 4A and attached to the eccentric bush 12 which will be described later via an orbit bearing 14.

On the rear face side of the orbiting scroll 4, for example, three attachment recesses 4D (only one attachment recess 4D is shown in FIG. 1) are provided at intervals in the circumferential direction of the orbiting scroll 4. The attachment recesses 4D are disposed in positions where they face the seat portions 1D (attachment recesses 1E) of the casing 1 in the axial direction. In the attachment recesses 4D, thrust receivers 18 of the ball coupling mechanism 15 which will be described later are fit and attached.

The boss portion 4C of the orbiting scroll 4 is disposed so that an axis O2-O2 as the center is eccentric in the radial direction from the axis O1-O1 as the center of the fixed scroll 2 only by a predetermined dimension δ. In this state, the wrap portion 4B of the orbiting scroll 4 is disposed so as to overlap the wrap portion 2B of the fixed scroll 2. A plurality of compression chambers 5, 5, . . . are defined between the wrap portions 2B and 4B.

The orbiting scroll 4 is driven by the electric motor 8 via a rotary shaft 9 which will be described later and the eccentric bush 12 to perform an orbiting motion on the fixed scroll 2 in a state where rotation of the orbiting scroll 4 is regulated by the ball coupling mechanism 15 which will be described later. That is, the orbiting scroll 4 performs the orbiting operation around the axis O1-O1 of the fixed scroll 2 with an orbiting radius of the amount of the dimension δ.

The compression chamber 5 on the outer diameter side out of the plurality of compression chambers 5 takes air from an intake port 6 provided on the outer peripheral side of the fixed scroll 2 and compresses the air in each of the compression chambers 5 with the orbiting operation of the orbiting scroll 4. The compression chamber 5 on the inner diameter side discharges the compressed air to the outside from a discharge port 7 provided in the center of the fixed scroll 2.

Reference numeral 8 denotes the electric motor as a drive source provided on the side of the bottom side 1B of the casing 1. The output shaft 8A of the electric motor 8 is coupled integrally to the rotary shaft 9 which will be described later. The output shaft 8A of the electric motor 8 rotates around the axis O1-O1 of FIG. 1 as a center, thereby orbiting the orbiting scroll 4 via the rotary shaft 9 which will be described later, the eccentric bush 12, and the like.

Reference numeral 9 denotes the rotary shaft rotatably provided in the bearing attachment portion 1C of the casing 1 via a bearing 10 and the like. As shown in FIG. 1, the base side (the other side in the axial direction) of the rotary shaft 9 is detachably fixed to the output shaft 8A of the electric motor 8, and is rotatingly driven by the electric motor 8. To the front side of the rotary shaft 9 (one side in the axial direction), the boss portion 4C of the orbiting scroll 4 is orbitably coupled via the eccentric bush 12 and the orbit bearing 14.

On the base side of the rotary shaft 9, as shown in FIG. 1, a sub weight 11 extending outward in the radial direction is integrally formed. The sub weight 11 has the function of canceling the centrifugal force generated when each of the balanced weights 13 which will be described later and the orbiting scroll 4 rotates, acting as an external force (moment force) of tilting the rotary shaft 9 or the like.

Reference numeral 12 denotes the cylindrical eccentric bush with steps provided at the front end side of the rotary shaft 9. The eccentric bush 12 rotates integrally with the rotary shaft 9 and converts the rotation to the orbiting motion of the orbiting scroll 4 via the orbit bearing 14. The balance weight 13 is integrally formed on the outer periphery side of the eccentric bush 12 in order to stabilize the orbiting operation of the orbiting scroll 4.

Reference numeral 14 denotes the orbit bearing disposed between the boss portion 4C of the orbiting scroll 4 and the eccentric bush 12. The orbit bearing 14 supports the boss portion 4C of the orbiting scroll 4 so as to orbit with respect to the eccentric bush 12. The orbit bearing 14 is provided to assure that the orbiting scroll 4 orbits with the orbiting radius (dimension δ) with respect to the axis O1-O1 of the rotary shaft 9.

Reference numerals 15, 15, . . . denote ball coupling mechanisms as rotation preventing mechanisms provided between the bottom portion 1B of the casing 1 and the rear side of the orbiting scroll 4. A plurality of sets (for example, three sets as shown in FIG. 2) of the ball coupling mechanisms 15 are disposed between the seat portions 1D of the casing 1 and the attachment recesses 4D in the orbiting scroll 4 as shown in FIG. 1. Each of the ball coupling mechanisms 15 receives a thrust load via the thrust receivers 16 and 18, spherical bodies 20, and the like, and prevents rotation of the orbiting scroll 4 by using a cylindrical ring 21 which will be described later and the like.

In this case, it is sufficient to provide sets of ball coupling mechanisms 15 between the casing 1 and the orbiting scroll 4 at least in three places at intervals in the circumferential direction in order to receive the thrust load from the orbiting scroll. Each set of the ball coupling mechanism 15 is made of the thrust receivers 16 and 18 and the sphere 20. To prevent rotation of the orbiting scroll 4, it is sufficient to provide sets of the cylindrical rings 21 which will be described later and the thrust receivers 16 and 18 at least in two places.

Reference numeral 16 denotes a first thrust receiver as a part of the ball coupling mechanism 15. The first thrust receiver 16 is formed as a bottomed cylindrical body made of a metal material having, for example, rigidity as shown in FIGS. 3 to 6. The thrust receiver 16 includes a cylindrical portion 16A whose one end in the axial direction is open and using an axis X1-X1 as a center, and a bottom portion 16B closing the other end in the axial direction of the cylindrical portion 16A.

Figure 3:
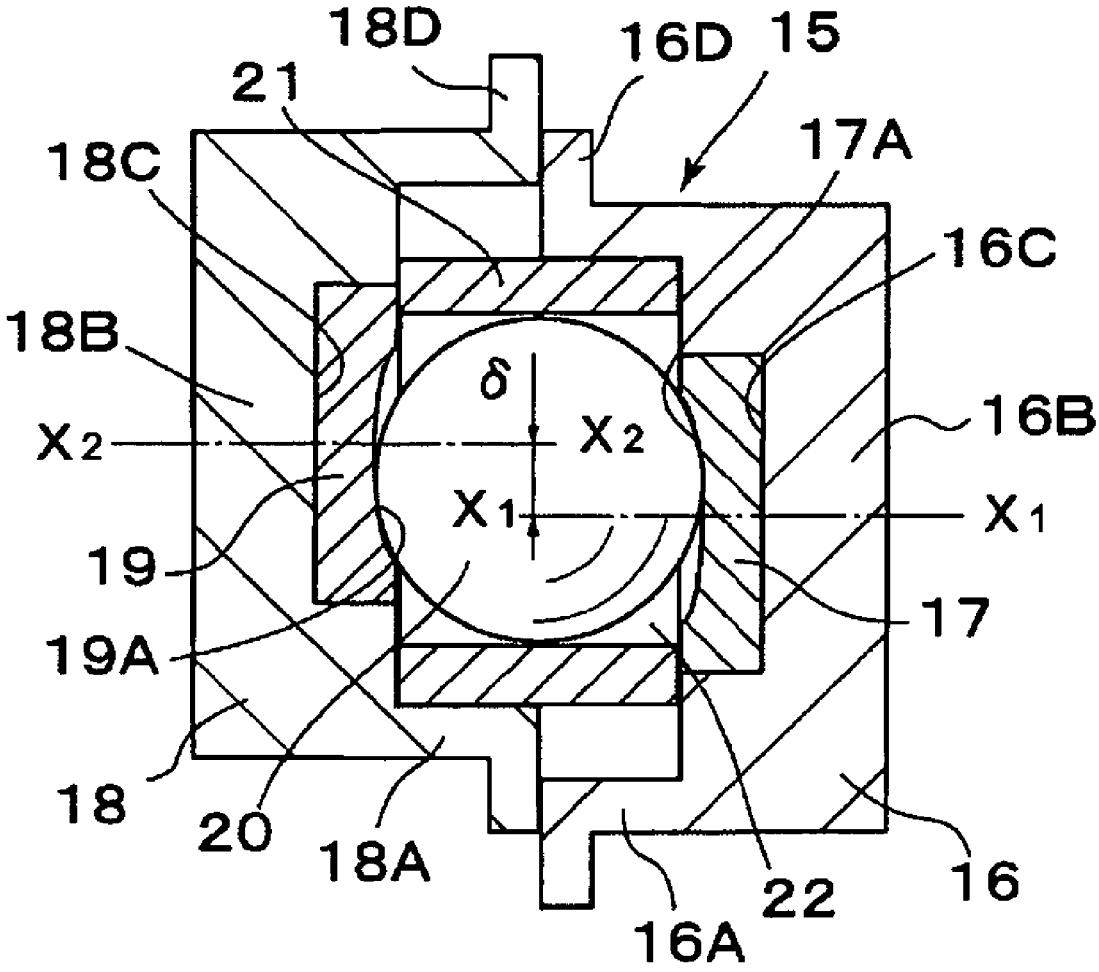
FIG. 3 is an enlarged longitudinal sectional view of the ball coupling mechanism in FIG. 1.
Figure 4:
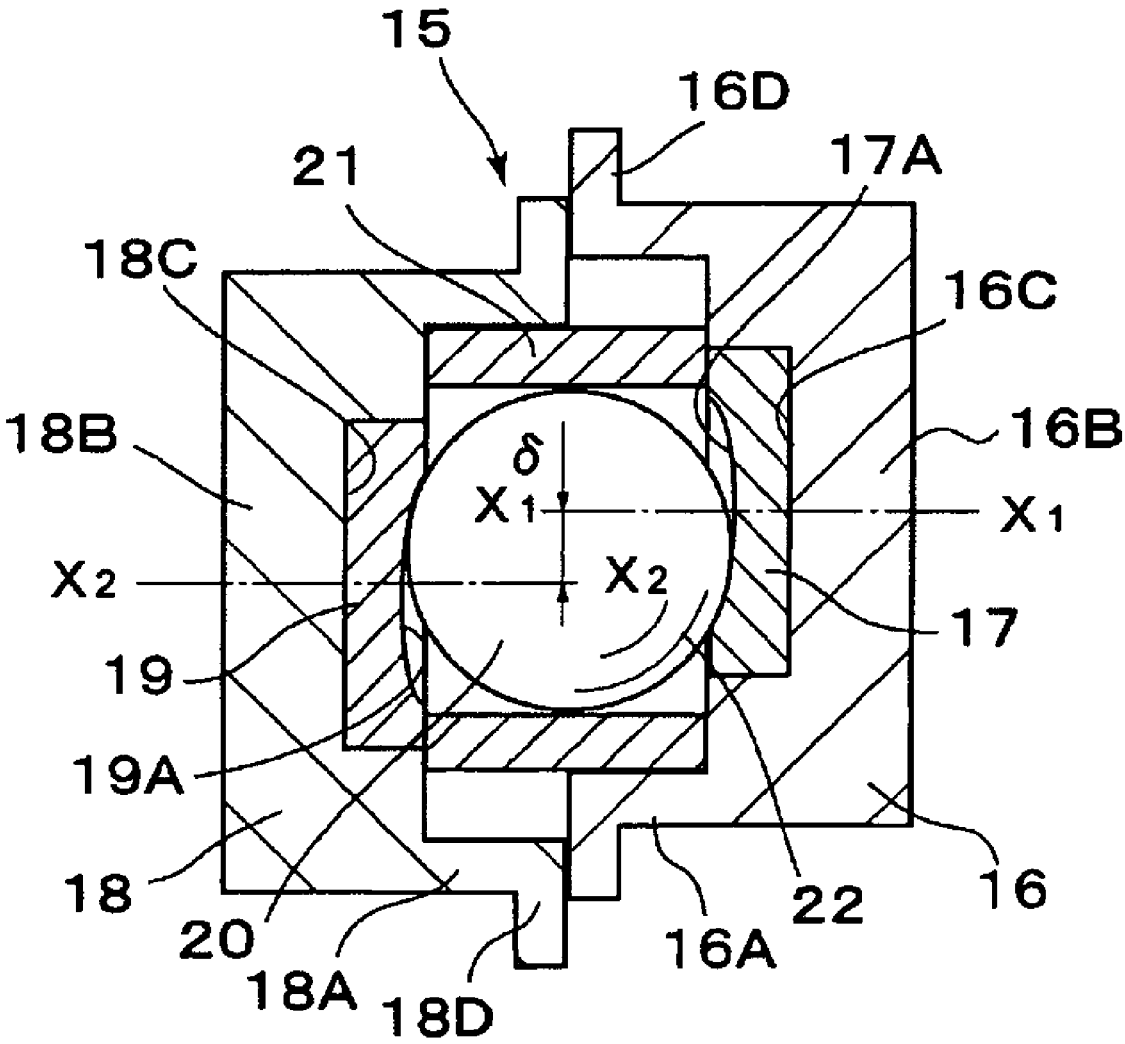
FIG. 4 is a longitudinal sectional view of the ball coupling mechanism showing a state where a thrust receiver in FIG. 3 is moved by an orbiting operation.
Figure 5:
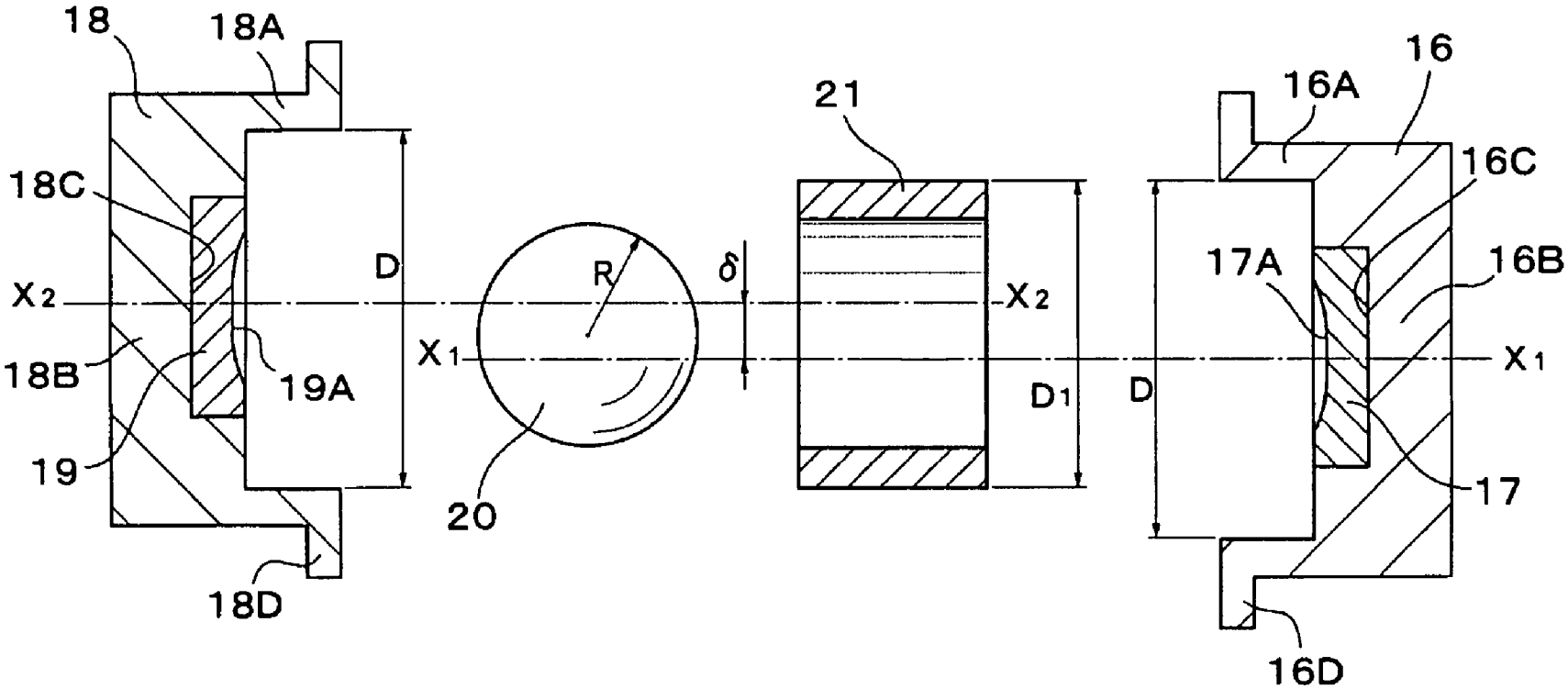
FIG. 5 is a longitudinal sectional view showing an exploded state of the thrust receiver, a sphere, and a cylindrical ring in FIG. 3.
Figure 6:
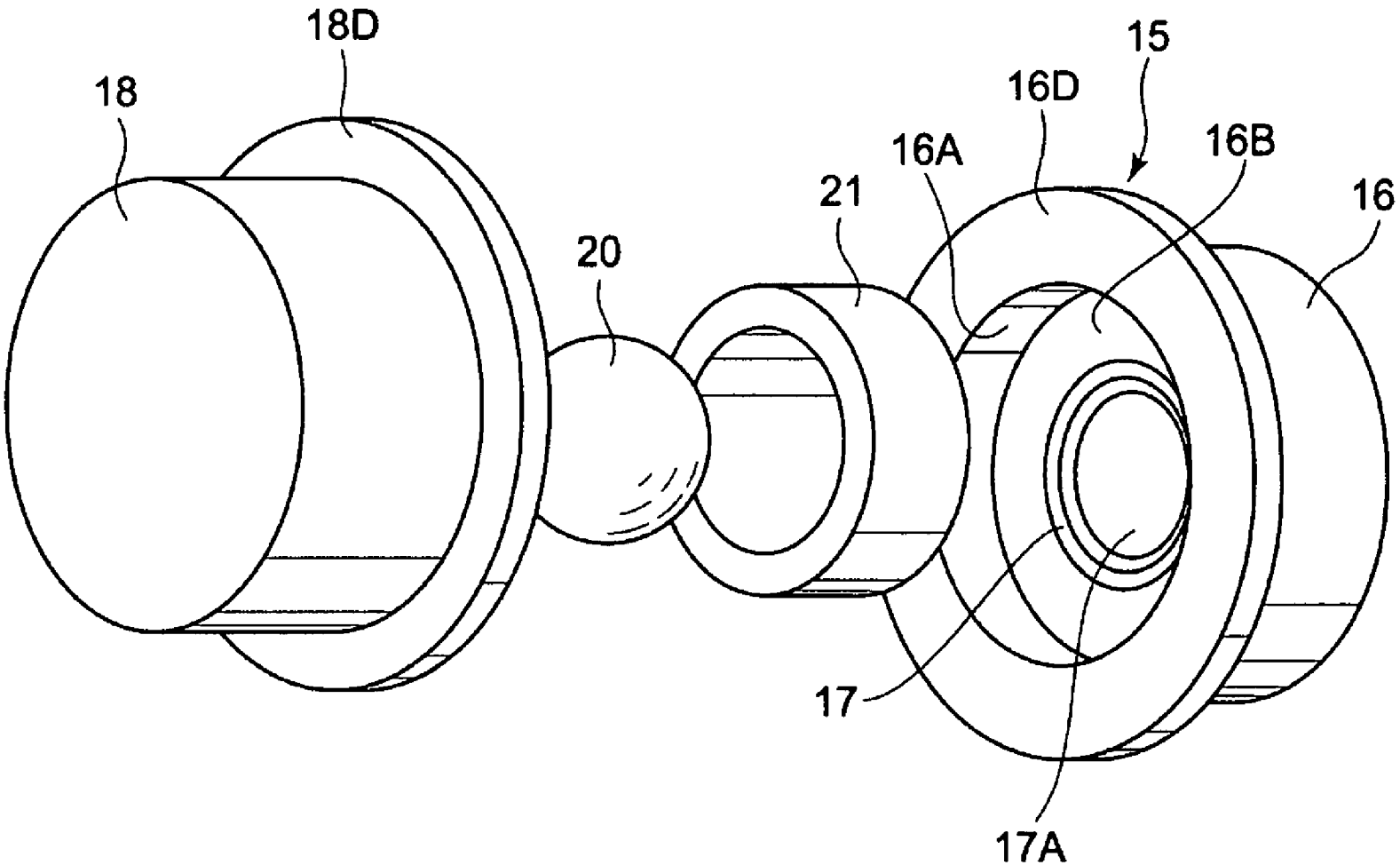
FIG. 6 is an exploded perspective view showing the thrust receiver, the sphere, and the cylindrical ring in FIG. 3.

The first thrust receiver 16 is formed in such a manner that the inner diameter D of the cylindrical portion 16A is larger than the (outer diameter D1) of the cylindrical ring 21 which will be described later only by an amount 6 as shown in FIG. 5. In the bottom portion 16B of the thrust receiver 16, as shown in FIGS. 3 to 5, a groove 16C having a circular shape using the axis X1-X1 as a center is formed in the bottom surface facing the sphere 20 which will be described later. In the groove 16C, a reception plate 17 which will be described later is fixedly attached in an engagement state.

In the first thrust receiver 16, an annular flange 16D extending outward in the radial direction from the open end of the cylindrical portion 16A is formed. The flange 16D is either in slidable contact with a flange 18D on the other side which will be described later or facing the flange 18D with a narrow gap therebetween. The bottom portion 16B side of the first thrust receiver 16 is fixed in such a manner that the bottom portion 16B side is fit in the attachment recess 1E in the casing 1 (seat portion 1D) (refer to FIG. 1). The axis X1-X1 of the first thrust receiver 16 is disposed in parallel with the axis O1-O1 of the casing 1.

Reference numeral 17 denotes the first reception plate serving as a seating face of the first thrust receiver 16. As shown in FIGS. 3 to 5, the reception plate 17 is formed in a disc shape using a hard material of high abrasion resistance and is fit and attached in the groove 16C in the bottom portion 16B. A guide groove 17A as a circular shallow groove using the axis X1-X1 as a center is formed in the surface of the reception plate 17. The guide groove 17A has the function of guiding the sphere 20 which will be described later along a circular locus in accordance with the orbiting motion of the orbiting scroll 4.

Reference numeral 18 denotes a second thrust receiver provided on the rear side of the orbiting scroll 4 so as to face the first thrust receiver 16. The second thrust receiver 18 is formed as a bottomed cylindrical body made of a material similar to that of the first thrust receiver 16. The thrust first receiver 16 includes a cylindrical portion 18A formed using the axis X2-X2 as a center and a bottom portion 18B as shown in FIGS. 3 to 5.

The second thrust receiver 18 is also formed in such a manner that the cylindrical portion 18A has a dimension of the inner diameter D as shown in FIG. 5. In the second thrust receiver 18, a concave groove 18C having a circular shape using the axis X2-X2 as a center is formed. In the concave groove 18C, a reception plate 19 which will be described later is fixedly attached in an engagement state.

Also in the second thrust receiver 18, an annular flange 18D extending outward in the radial direction from the open end of the cylindrical portion 18A is formed. The flange 18D is either in slidable contact with the flange 16D on the other side or facing the flange 16D with a narrow gap therebetween. With the configuration, when a lubricant such as grease is housed between the first and second thrust receivers 16 and 18, a sealing effect of preventing the lubricant from leaking to the outside by the flanges 16D and 18D can be realized.

As shown in FIG. 1, the second thrust receiver 18 is fixed and engaged in the attachment recess 4D in the orbiting scroll 4 so as to face the first thrust receiver 16 in the axial direction. As shown in FIGS. 3 to 5, the second thrust receiver 18 is disposed so that its axis X2-X2 is deviated from the axis X1-X1 of the first thrust receiver 16 only by the amount 6. The axis X2-X2 of the second thrust receiver 18 is parallel with the axis O2-O2 of the orbiting scroll 4.

Further, the second thrust receiver 18 and the first thrust receiver 16 are bilaterally symmetrical as shown in FIGS. 3 to 6. Consequently, the first and second thrust receivers 16 and 18 can be formed as the same parts.

Reference numeral 19 denotes the second reception plate serving as a seating face of the second thrust receiver 18. The reception plate 19 is configured similarly to the reception plate 17 formed in the first reception plate. As shown in FIGS. 3 to 5, the reception plate 19 is fit and attached in the concave groove 18C in the bottom portion 18B. A guide groove 19A as a circular shallow groove using the axis X2-X2 as a center is formed in the surface of the reception plate 19. The guide groove 19A has the function of guiding the sphere 20 which will be described later along a circular locus in accordance with the orbiting motion of the orbiting scroll 4.

Reference numeral 20 denotes the sphere rotatably provided between the first and second thrust receivers 16 and 18 via the reception plates 17 and 19. The sphere 20 is formed as a ball having a radius R (refer to FIG. 5) and made from the materials of high rigidity such as a steel ball. The outer surface of the sphere 20 rotatably contacts with the guide grooves 17A and 19A in the reception plates 17 and 19, and a thrust load applied to the end plate 4A of the orbiting scroll 4 and the like at the time of compression operation is received by the seat portion 1D side of the casing 1 together with the first and second thrust receivers 16 and 18 (the reception plates 17 and 19).

Reference numeral 21 denotes a cylindrical ring as a cylindrical member constructing a part of the ball coupling mechanism 15. As shown in FIGS. 3 to 6, the cylindrical ring 21 is provided between the first and second thrust receivers 16 and 18 in a state where the sphere 20 is surrounded from the outside in the radial direction. The cylindrical ring 21 is formed so that its inner diameter is slightly larger than the outside diameter (2×R) of the sphere 20, and the sphere 20 is allowed to rotate in the cylindrical ring 21.

The cylindrical ring 21 is formed so that its outside diameter D1 (refer to FIG. 5) is smaller than the inner diameter D of the first and second thrust receivers 16 and 18 (cylindrical portions 16A and 18A) only by the dimension δ (orbiting radius) as shown by the following equation 1. The outer surface of the cylindrical ring 21 makes a rolling contact with the inner faces of the cylindrical portions 16A and 18A with the orbiting motion of the orbiting scroll 4 as shown in FIGS. 3 and 4. In such a manner, the cylindrical ring 21 displays the rotation preventing function of preventing rotation of the orbiting scroll 4.

$$D1 = D - \delta \qquad \text{Equation 1}$$

As shown in FIGS. 3 and 4, the end face of both sides in the axial direction of the cylindrical ring 21 face the side of the surfaces (inner faces) of the bottom portions 16B and 18B with a small gap or slidingly contact with the surfaces in the first and second thrust receivers 16 and 18. In such a manner, in the first and second thrust receivers 16 and 18, an inner space 22 surrounded by the bottom portions 16B and 18B and the inner surface of the cylindrical ring 21 can be formed as a lubricant holding space for holding a lubricant such as grease around the sphere 20.

In this case, a small gap is formed between the bottom portions 16B and 18B of the thrust receivers 16 and 18 and both ends in the axial direction of the cylindrical ring 21 due to dimension tolerance or the like. Consequently, the lubricant in the inner space 22 slightly leaks to the outside. However, the lubricant is prevented from leaking to the outside by the sealing action of the flanges 16D and 18D provided for the first and second thrust receivers 16 and 18.

The scroll type air compressor according to the embodiment has the configuration as described above, thus description will not be repeated here. Instead, description will now be made of the operation.

First, when power is supplied from the outside to the electric motor 8 to rollingly drive the rotary shaft 9 and the eccentric bush 12 by the output shaft 8A using the axis O1-O1 as a center, the orbiting scroll 4 performs orbiting motion with a predetermined orbiting radius (the dimension δ in FIG. 1) in a state where the rotation of the orbiting scroll 4 is regulated by, for example, two sets or more of the ball coupling mechanisms 15.

Each of the compression chambers 5 defined between the wrap portion 2B of the fixed scroll 2 and the wrap portion 4B of the orbiting scroll 4 is continuously reduced from the outer diameter side to the inner diameter side. The compression chamber 5 on the outer diameter side out of the compression chambers 5 takes air through the intake port 6 provided on the outer peripheral side of the fixed scroll 2 and, while continuously compressing the air in each of the compression chambers 5, discharges the compressed air from the compression chamber 5 on the inner diameter side via the discharge port 7 to the outside.

In such a compression operation, the pressure of air compressed in the compression chambers 5 acts as a thrust load on the end plate 4A of the orbiting scroll 4. Between the seat portion 1D of the casing 1 and the rear side of the orbiting scroll 4, for example, three sets of ball coupling mechanisms 15 are disposed. Each of the ball coupling mechanisms 15 is constructed by the first and second thrust receivers 16 and 18 (the reception plates 17 and 19), the sphere 20, the cylindrical ring 21, and the like.

With the configuration, the thrust load applied to the end plate 4A of the orbiting scroll 4 can be received between the first and second thrust receivers 16 and 18 (reception plates 17 and 19) of the ball coupling mechanism 15 and the sphere 20. The orbiting scroll 4 can be prevented from being displaced in the axial direction of the casing 1 or being tilting with respect to the fixed scroll 2. Thus, the orbiting operation of the orbiting scroll 4 can be stabilized.

In the ball coupling mechanism 15 employed in the embodiment, the cylindrical ring 21 surrounding the sphere 20 from the outside in the radial direction between the first and second thrust receivers 16 and 18 is provided. The outside diameter D1 (refer to FIG. 5) of the cylindrical ring 21 is set to be smaller than the inner diameter D of the first and second thrust receivers 16 and 18 (cylindrical portions 16A and 18A) only by the dimension δ (orbiting radius) as shown by the equation 1.

With the configuration, as shown in FIGS. 3 and 4, the outer peripheral surface of the cylindrical ring 21 disposed between the first and second thrust receivers 16 and 18 is continuously making a rolling contact with the inner face of the cylindrical portions 16A and 18A in accordance with the orbiting motion of the orbiting scroll 4. Consequently, for example, the second thrust receiver 18 can be regulated from being displaced (deviated) to a position exceeding the first thrust receiver 16 by the dimension δ (orbiting radius). Therefore, the rotating operation of the orbiting scroll 4 can be regulated, and a so-called rotation preventing effect can be realized.

In the first and second thrust receivers 16 and 18, by making end faces on both sides in the axial direction of the cylindrical ring 21 slidingly contact with the surface (inner surface) side of the bottom portions 16B and 18B, the inner space 22 (refer to FIGS. 3 and 4) surrounded by the bottom portions 16B and 18B and the inner peripheral surface of the cylindrical ring 21 can be formed. A lubricant such as grease can be held in the periphery of the sphere 20 in the inner space 22. By this, the space between the guide grooves 17A and 19A of the reception plates 17 and 19 and the sphere 20 can be held in a lubricant state for a long period.

Moreover, in the first and second thrust receivers 16 and 18, the annular flanges 16D and 18D outwardly protruding in the radial direction from the open ends of the cylindrical portions 16A and 18A are integrally formed, and are allowed to be in slidable contact with each other. As a result, when the lubricant such as grease is housed between the first and second thrust receivers 16 and 18, the lubricant can be prevented from being leaked to the outside of the thrust receivers 16 and 18 by the flanges 16D and 18D. The lubricant sealing effect can be achieved.

In the embodiment, each of the ball coupling mechanisms 15 provided between the casing 1 and the orbiting scroll 4 is constructed by: the first thrust receiver 16 provided in the casing 1 in a position where it faces the rear side of the orbiting scroll 4 and having the reception plate 17 in its bottom portion 16B; the second thrust receiver 18 provided on the rear side of the orbiting scroll 4 so as to face the first thrust receiver 16 in the axial direction and having the reception plate 19 in its bottom portion 18B; the sphere 20 rotatably provided between the thrust receivers 16 and 18 (reception plates 17 and 19); and the rotation preventing cylindrical member (cylindrical ring 21) positioned between the first and second thrust receivers 16 and 18, surrounding the sphere 20 from the outside in the radial direction, and in rolling-contact with the inner surface of the cylindrical portions 16A and 18A, thereby preventing rotation of the orbiting scroll 4.

With the configuration, the thrust load from the orbiting scroll 4 can be excellently received by the thrust receivers 16 and 18 (reception plates 17 and 19) of the ball coupling mechanism 15 and the sphere 20. The rotation of the orbiting scroll 4 can be smoothly prevented by the cylindrical portions 16A and 18A of the thrust receivers 16 and 18 and the cylindrical ring 21. By using a few sets of the ball coupling mechanisms 15, the attachment space (occupation area) of the ball coupling mechanisms 15 in the casing 1 can be reduced, and workability at the time of assembly can be improved.

In this case, it is sufficient to provide the sets of ball coupling mechanisms 15 at least in three places at intervals in the circumferential direction in order to receive the thrust load from the orbiting scroll 4. Each set of the ball coupling mechanisms 15 is made of the thrust receivers 16 and 18 and the sphere 20. To prevent rotation of the orbiting scroll 4, it is sufficient to provide sets of the cylindrical rings 21 which will be described later and the thrust receivers 16 and 18 at least in two places. In this way, the attachment space of the ball coupling mechanism 15 in the casing 1 can be reduced, and flexibility of designing and the like can be increased.

In particular, by disposing the sphere 20 that receives the thrust load and the cylindrical ring 21 for preventing rotation of the orbiting scroll 4 concentrically as shown in FIG. 2, the occupation area of each of the ball coupling mechanism 15 on the rear side of the orbiting scroll 4 can be set to be small, and the flexibility of designing and the like can be increased.

Since the occupation area of the ball coupling mechanisms 15 provided between the casing 1 and the orbiting scroll 4 can be reduced, draft resistance at the time of making cooling air flow between the casing 1 and the orbiting scroll 4 can be reduced to be low, and the cooling effect of the orbiting scroll 4 can be increased.

Moreover, by housing the lubricant such as grease in the periphery of the sphere 20 in the inner space 22 surrounded by the bottom portions 16B and 18B of the thrust receivers 16 and 18 and the inner face of the cylindrical ring 21, the lubricating performance of the sphere 20 used for the ball coupling mechanism 15 can be increased, and the durability and life of the ball coupling mechanism 15 can be improved. Oilless operation can be performed for long time and reliability of the machine can be improved.

It is unnecessary to provide a part for supporting the rear side of the orbiting scroll 4 other than the thrust receiver 16 of the ball coupling mechanism 15 on the side of the seat portion 1D and the attachment recess 1E of the casing 1. Therefore, flexibility in designing at the time of manufacturing the casing 1 is high and, by decreasing the number of parts, workability at the time of assembly can be improved. Further, the first and second thrust receivers 16 and 18 are bilaterally symmetrical as shown in FIGS. 3 to 6. Consequently, the first and second thrust receivers 16 and 18 can be formed as the same parts.

Figure 7:
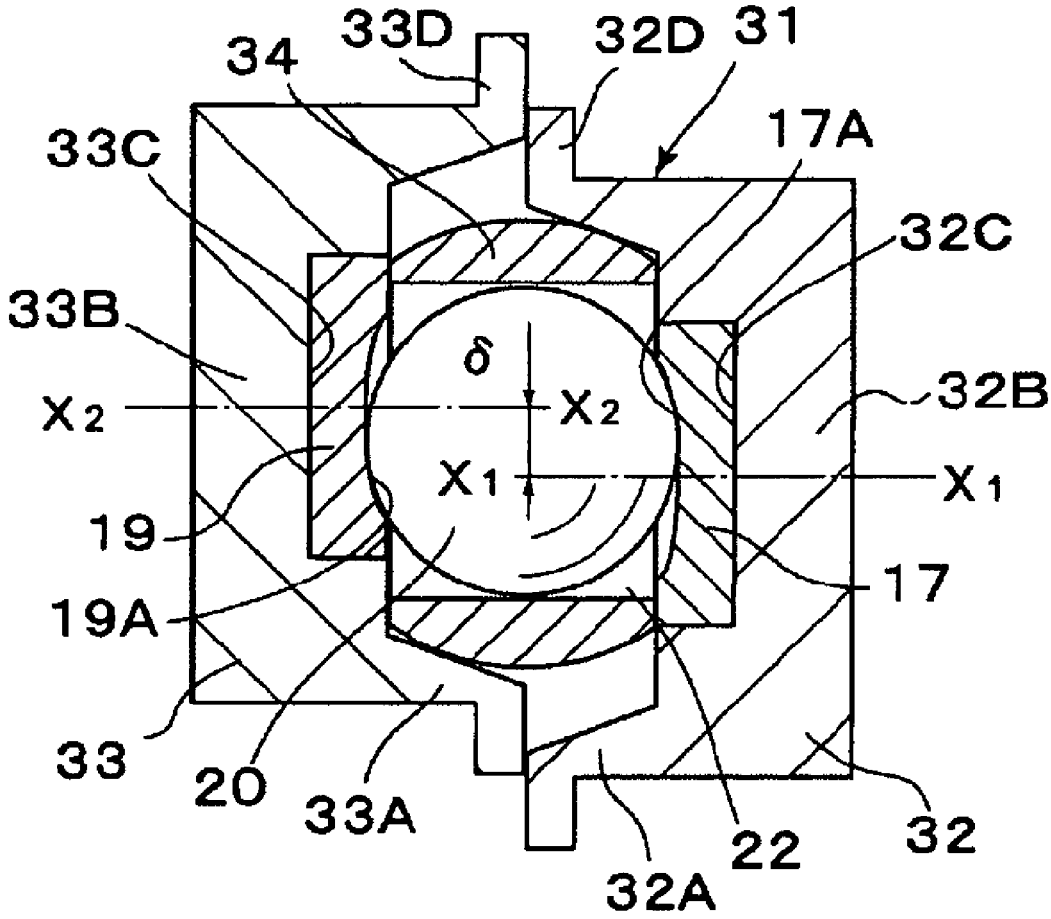
FIG. 7 is a longitudinal sectional view showing a ball coupling mechanism according to a second embodiment.

FIG. 7 shows a second embodiment of the present invention. The second embodiment is featured in that the outer shape of the cylindrical member is formed in a spherical shape, the first and second thrust receivers face the cylindrical member in the radial direction, and the inner surface of the cylindrical part making a rolling contact is formed in a tapered surface so as to form a cone shape. Incidentally, in the second embodiment, the same structural elements as those in the first embodiment are designated by the same reference numerals, thus description will not be repeated here.

In FIG. 7, reference numeral 31 denotes a ball coupling mechanism employed in the second embodiment. The ball coupling mechanism 31 includes, in a manner similar to the ball coupling mechanism 15 described in the first embodiment, the sphere 20, first and second thrust receivers 32 and 33, a cylindrical ring 34, and so forth, which will be described later.

Reference numeral 32 denotes the first thrust receiver employed in the second embodiment. The first thrust receiver 32 is constructed in a manner similar to the first thrust receiver 16 in the first embodiment, and has a cylindrical portion 32A, a bottom portion 32B, a groove 32C, and a flange 32D. The thrust receiver 32 is different from the first embodiment with respect to the point that the inner surface of the cylindrical portion 32A is formed as a tapered surface in a conic shape which is gradually tapered from the bottom portion 32B side toward the open end side.

Reference numeral 33 denotes the second thrust receiver employed in the second embodiment. The second thrust receiver 33 is constructed in a manner similar to the second thrust receiver 18 in the first embodiment, and has a cylindrical portion 33A, a bottom portion 33B, a groove 33C, and a flange 33D. The thrust receiver 33 is different from the first embodiment with respect to the point that the inner surface of the cylindrical portion 33A is formed as a tapered surface in a conic shape which is gradually tapered from the bottom portion 33B side toward the open end side.

Reference numeral 34 denotes a cylindrical ring as a cylindrical member. The cylindrical ring 34 is constructed in a manner similar to the cylindrical ring 21 in the first embodiment. The cylindrical ring 34 in this case is different from the first embodiment with respect to the point that its outer peripheral surface which faces and makes a rolling contact with the inner surface of the cylindrical portions 32A and 33A in the radial direction is formed in a spherical shape.

Also in the second embodiment employing such a configuration, the outer peripheral surface of the cylindrical ring 34 disposed between the first and second thrust receivers 32 and 33 makes a rolling contact with the inner peripheral surface of the cylindrical portions 32A and 33A in accordance with the orbiting motion of the orbiting scroll 4, and effects similar to those of the first embodiment can be obtained. The first and second thrust receivers 32 and 33 can be formed as the same parts.

Moreover, in the second embodiment, the outer shape of the cylindrical ring 34 is formed in a spherical shape, and the inner peripheral surface of the cylindrical portions 32A and 33A of the first and second thrust receivers 32 and 33, with which the cylindrical ring 34 makes a rolling contact, is formed as a tapered surface. Consequently, the outer peripheral surface (spherical surface in a conic shape) of the cylindrical ring 34 does not come into lean-contact with the inner peripheral surface of the cylinder portions 32A and 33A. Rolling-contact of the cylindrical ring 34 with the inner peripheral surface (tapered surface) of the cylindrical portions 32A and 33A is stabilized, and smoother rotation preventing action can be realized.

The outer shape of the cylindrical member may be formed as a tapered surface of a conic shape whose cross section has an isosceles triangle shape, and the first and second thrust receivers may have a configuration that the inner surface of the cylindrical portion which faces the cylindrical member in the radial direction and comes into a rolling-contact with the cylindrical member is formed in a spherical shape.

Moreover, in the embodiment, the outer shape of the cylindrical ring is formed as a tapered surface whose cross section has an isosceles triangle shape, and the first and second thrust receivers are formed so that the inner surface of each of the cylindrical portions with which the cylindrical ring makes a rolling contact is formed in an inclined plane in a spherical manner with the inner peripheral surface having a protruded curve which forms a recess. Consequently, the outer peripheral surface (tapered surface) of the cylindrical ring does not come into lean-contact with the inner peripheral surface (projected curved surface) of each of the cylinder portions. Rolling-contact of the cylindrical ring with the inner peripheral surfaces of the cylindrical portions is stabilized, and smoother rotation preventing action can be realized.

Further, the first and second thrust receivers may be provided with sealing means between cylindrical portions which open and face each other. The sealing means seals, between the thrust receivers, the lubricant for holding the sphere in a lubricating state so that the lubricant does not leak to the outside.

Even in the case where the lubricant in the inner space 22 leaks to the outside, the lubricant can be sealed between the annular flat plate and the cylindrical portions, and can be effectively prevented from leaking to the outside.

By providing the annular flat plate for the cylindrical ring, falling of the cylindrical ring and the like can be prevented excellently. By the sealing operation of the annular flat plate, flanges (for example, the flanges 16D and 18D described in the first embodiment) and the like can be made unnecessary. The shape and structure of the first and second thrust receivers can be simplified.

Further, the cylindrical member and the seal member may be constructed by different members, and the inner peripheral side of the seal member may be fit and assembled in the cylindrical member.

The dimension in the axial direction (length) of the cylindrical member may be set to be short to form a gap between the bottom portions of the thrust receivers and both ends in the axial direction of the cylindrical member. In this case, leakage of the lubricant housed in the first and second thrust receivers to the outside is prevented by sealing the lubricant with the annular flat plate provided integrally with the outer periphery side of the cylindrical ring in cooperation with the cylindrical portions.

Figure 8:
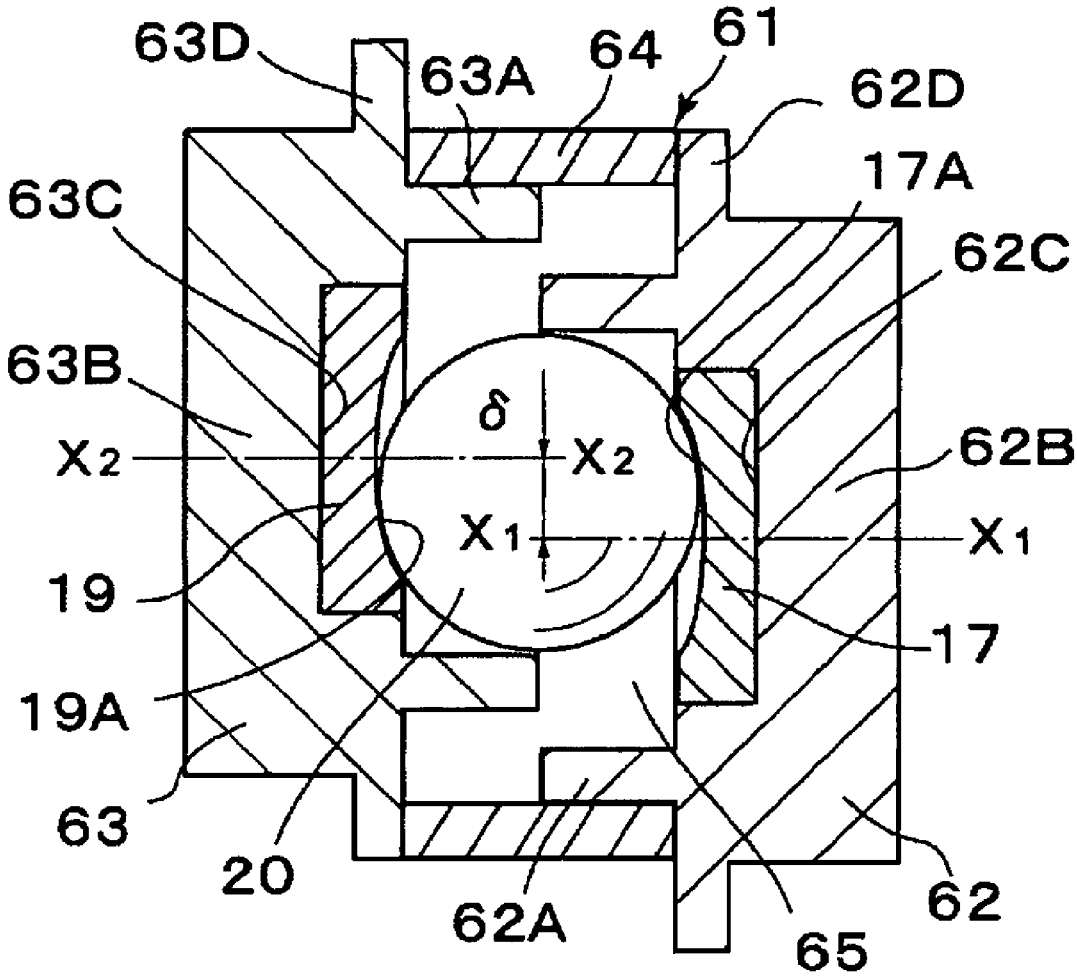
FIG. 8 is a longitudinal sectional view showing a ball coupling mechanism according to a third embodiment.
Figure 9:
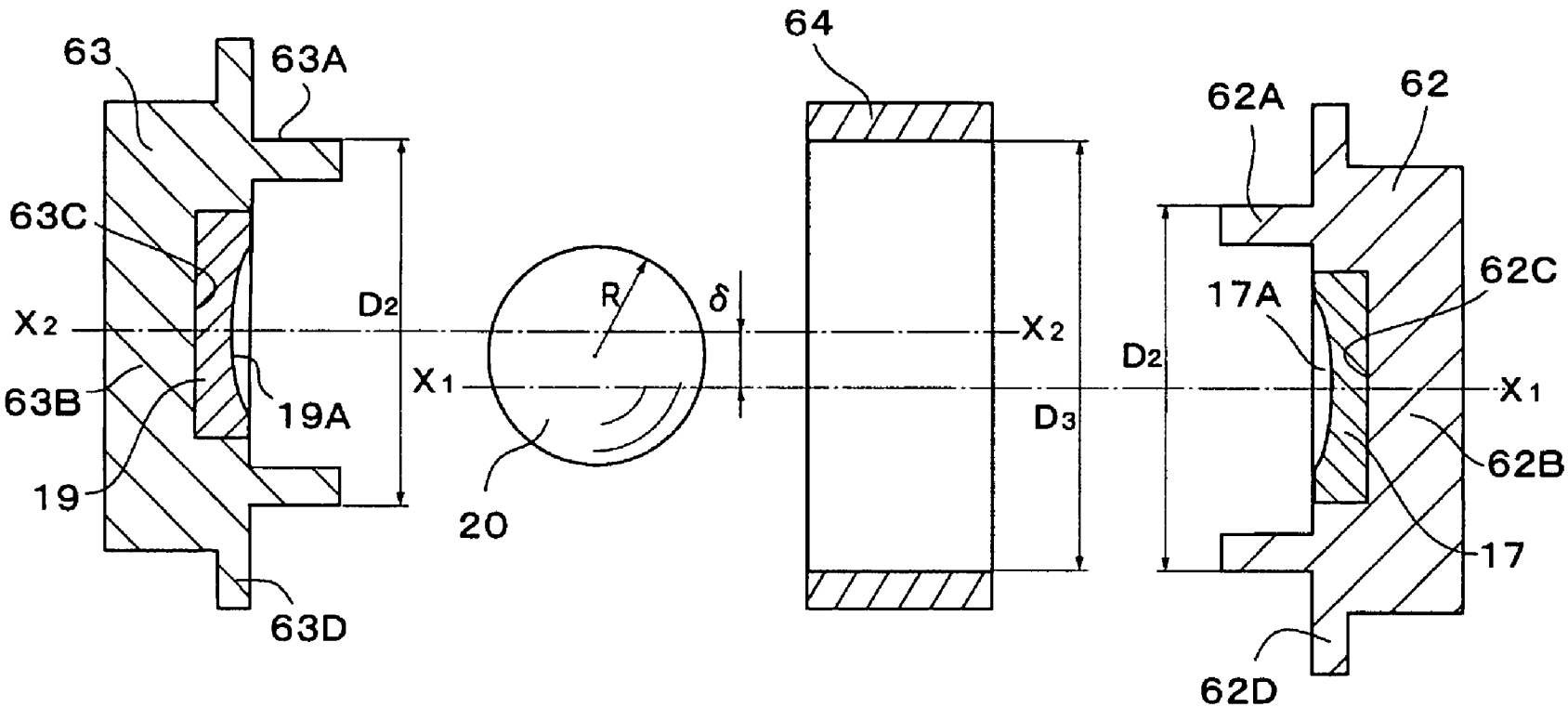
FIG. 9 is a longitudinal sectional view showing a thrust receiver, a sphere, and a cylindrical ring in FIG. 8 in an exploded state.

FIGS. 8 and 9 show a third embodiment of the present invention. The third embodiment is featured in that a rotation preventing cylindrical member makes a rolling contact with the outer peripheral side of each of cylindrical portions of the first and second thrust receivers. With the configuration, the rotation of the orbiting scroll is prevented. In the embodiment, the same structural elements as those in the first embodiment are assigned with the same reference numerals, thus description will not be repeated here.

In FIG. 8, reference numeral 61 denotes a ball coupling mechanism as a rotation preventing mechanism employed in the third embodiment. The ball coupling mechanism 61 has, like the ball coupling mechanism 15 described in the first embodiment, the sphere 20, first and second thrust receivers 62 and 63, and a cylindrical ring 64 which will be described later.

Reference numeral 62 denotes a first thrust receiver employed in the third embodiment. The first thrust receiver 62 is constructed in a manner similar to the first thrust receiver 16 in the first embodiment and has a cylindrical portion 62A, a bottom portion 62B, a groove 62C, and a flange 62D. However, in the thrust receiver 62 in this case, the outer shape of the bottom portion 62B has a diameter larger than that of the cylindrical portion 62A, and the annular flange 62D is protruded outwardly in the radial direction from an outer peripheral surface of the bottom portion 62B.

The inner diameter of the cylindrical portion 62A of the first thrust receiver 62 is set to be larger than the outer diameter of the sphere 20 only by about an amount of a dimension δ (orbiting radius) to surround the sphere 20 from the outside in cooperation with the other cylindrical portion 63A, thereby preventing the sphere 20 from dropping off. The cylindrical portion 62A has an outer diameter D2 shown in FIG. 9 which is smaller than an inner diameter D3 of the cylindrical ring 64 which will be described later only by the dimension δ as shown by the following equation 2.

Reference numeral 63 denotes a second thrust receiver employed in the embodiment. The second thrust receiver 63 is constructed in a manner similar to the second thrust receiver 18 in the first embodiment and has a cylindrical portion 63A, a bottom portion 63B, a concave groove 63C, and a flange 63D. However, in the thrust receiver 63 in this case, the outer shape of the bottom portion 63B has a diameter larger than that of the cylindrical portion 63A, and the annular flange 63D is protruded outwardly in the radial direction from an outer peripheral surface of the bottom portion 63B.

The inner diameter of the cylindrical portion 63A of the second thrust receiver 63 is set to be larger than the outer diameter of the sphere 20 only by about an amount of a dimension δ (orbiting radius) to surround the sphere 20 from the outside in cooperation with the other cylindrical portion 62A, thereby preventing the sphere 20 from dropping off. The cylindrical portion 63A has an outer diameter D2 (refer to FIG. 9) which is smaller than the inner diameter D3 of the cylindrical ring 64, which will be described later, only by the dimension δ.

Reference numeral 64 denotes a cylindrical ring as a cylindrical member. The cylindrical ring 64 is constructed in a manner similar to the cylindrical ring 21 in the first embodiment. The cylindrical ring 64 in this case is different from the first embodiment with respect to the point that its inner peripheral surface faces and makes a rolling contact with the outer surface of the cylindrical portions 62A and 63A in the radial direction.

Specifically, the inner diameter D3 of the cylindrical ring 64 is larger than the outer diameter D2 of the cylindrical portions 62A and 63A only by the amount of the dimension δ (orbiting radius). When the orbiting scroll 4 performs an orbiting operation, the cylindrical ring 64 makes a rolling contact with the outer peripheral surface of the cylindrical portions 62A and 63A in the first and second thrust receivers 62 and 63, thereby preventing rotation of the orbiting scroll 4.

$$D3 = D2 + \delta \qquad \text{Equation 2}$$

End faces on both sides in the axial direction of the cylindrical ring 64 face or slidingly contact with the flanges 62D and 63D of the first and second thrust receivers 62 and 63 with a small gap therebetween. With the configuration, between the first and second thrust receivers 62 and 63, an inner space 65 surrounded by the flanges 62D and 63D and the inner surface of the cylindrical ring 64 is formed. The inner space 65 functions as a lubricant holding space for holding the lubricant such as grease around the sphere 20.

Also in the third embodiment employing such a configuration, the inner peripheral surface of the cylindrical ring 64 disposed between the first and second thrust receivers 62 and 63 makes a rolling contact with the outer peripheral surface of the cylindrical portions 62A and 63A in accordance with the orbiting motion of the orbiting scroll 4, and operational effects similar to those of the first embodiment can be obtained.

In the third embodiment, the inner diameter of the cylindrical ring 64 is set to be larger than the outer diameter of the cylindrical portions 62A and 63A only by the amount of the dimension δ (orbiting radius). Between the first and second thrust receivers 62 and 63, the inner space 65 surrounded by the flanges 62D and 63D and the inner peripheral surface of the cylindrical ring 64 is formed as a lubricant holding space.

Consequently, a larger amount of the lubricant such as grease can be housed in the inner space 65. The periphery of the sphere 20 can be excellently lubricated, and the space between the first and second thrust receivers 62 and 63 (the cylindrical portions 62A and 63A) and the cylindrical ring 64 can be also continuously lubricated excellently. The first and second thrust receivers 62 and 63 can be formed as the same parts.

The inner shape of the cylindrical member may be formed as a tapered surface of a circular cone whose cross section has an isosceles triangle shape, and the first and second thrust receivers may have a configuration that the outer surface of the cylindrical portion which faces the cylindrical member in the radial direction and makes a rolling contact with the cylindrical member is also formed as a tapered surface of a conic shape.

In the embodiment, falling of the cylindrical ring and the like can be prevented excellently.

The internal shape of the cylindrical member may be formed by a spherical surface having a recessed curve. The first and second thrust receivers may be formed in such a manner that an outer peripheral surface of a cylindrical portion facing the cylinder member in the radial direction and in rolling contact may be formed in a spherical surface having a protruded curve which is tapered.

Rolling-contact of the cylindrical ring with the outer peripheral surface of the cylindrical portions is stabilized, and smoother rotation preventing action can be realized.

In the first and second thrust receivers, sealing means may be provided between cylindrical portions on the inside in the radial direction of the cylindrical member.

The internal shape of the cylindrical member may be formed by a spherical surface having a recessed curve. On the inner peripheral side of the cylindrical member, sealing means for sealing a space between cylindrical portions in the first and second thrust receivers may be provided.

Figure 10:
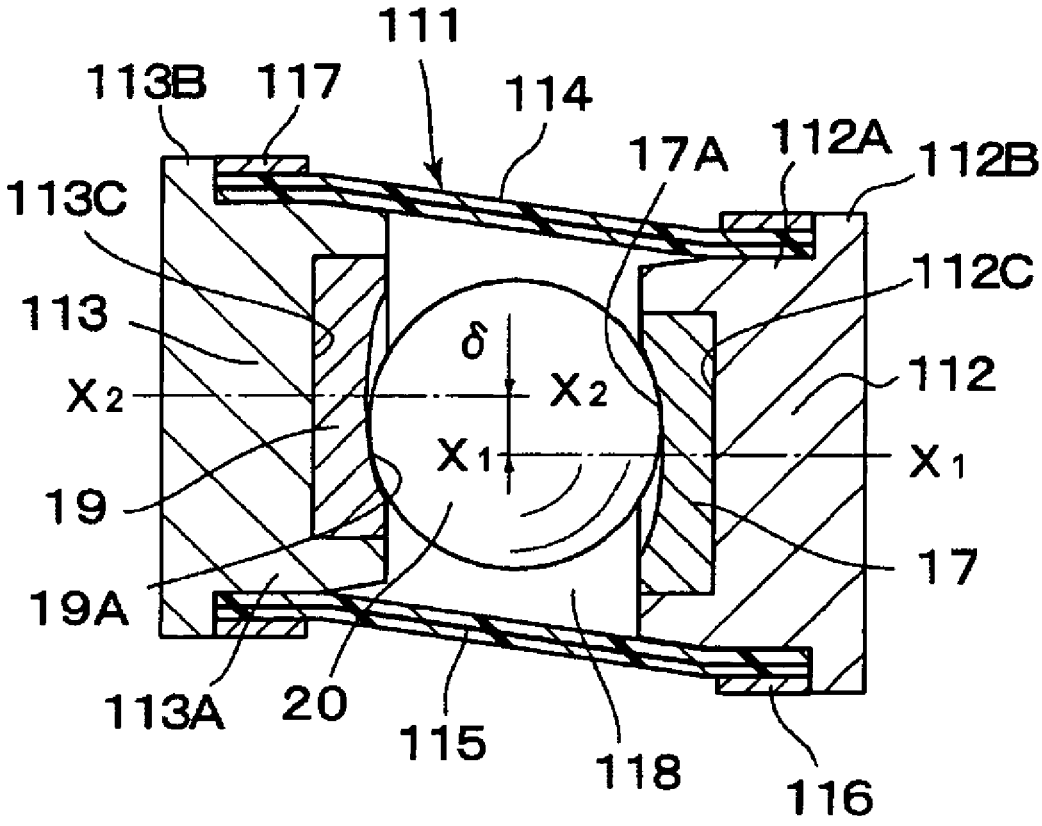
FIG. 10 is a longitudinal sectional view showing a ball coupling mechanism according to a fourth embodiment.

FIG. 10 shows a fourth embodiment of the present invention. The fourth embodiment is featured in that a rotation preventing cylindrical member is provided so that both ends in the axial direction are fixed to a casing side and an orbiting scroll side in a state where a sphere is surrounded from the outside in the radial direction. The cylindrical member is configured such that deformation in the axial direction is regulated while deformation in the radial direction is permitted, thereby preventing rotation of the orbiting scroll. In the fourth embodiment, the same structural elements as those in the first embodiment are assigned with the same reference numerals, thus description will not be repeated here.

In FIG. 10, reference numeral 111 denotes a ball coupling mechanism employed in the fourth embodiment. In a manner similar to the ball coupling mechanism 15 in the first embodiment, the ball coupling mechanism 111 comprises: the sphere 20; and first and second thrust receivers 112 and 113 which will be described later. However, the ball coupling mechanism 111 in this case is different from the first embodiment with respect to the point that a resin boot 114 which will be described later is employed as a cylindrical member.

Reference numeral 112 denotes a first thrust receiver as a part of the ball coupling mechanism 111. The first thrust receiver 112 is formed as, for example, a solid body having a protruded shape and made of a metal material having rigidity. A circular boot attachment portion 112A and an annular flange 112B having a diameter larger than that of the boot attachment portion 112A are provided on the outer peripheral side.

The flange 112B side of the first thrust receiver 112 is fixed by being fit in the attachment recess 1E in the casing 1 (seating portion 1D), for example, illustrated in FIG. 1. The axis X1-X1 of the first thrust receiver is disposed in parallel with the axis O1-O1 of the casing 1. In the first thrust receiver 112, a concave groove 112C as a circular groove using the axis X1-X1 is formed on the surface side facing the sphere 20. The reception plate 17 described in the first embodiment is fixed in the concave groove 112C in an engagement state.

Reference numeral 113 denotes a second thrust receiver opposite to the first thrust receiver 112 and provided on the rear side of the orbiting scroll 4. The second thrust receiver 113 is formed as a solid body having a protruded shape and made of a material similar to that of the first thrust receiver 12. A circular boot attachment portion 113A and an annular flange 113B are provided on the outer peripheral side.

The flange 113B side of the second thrust receiver 113 is fixed by being fit in the attachment recess 4D in the orbiting scroll 4, for example, illustrated in FIG. 1. The axis X2-X2 of the second thrust receiver 113 is disposed so as to be deviated from the axis X1-X1 of the first thrust receiver 112 only by the dimension δ. The axis X2-X2 of the second thrust receiver 113 is disposed in parallel with the axis O2-O2 of the orbiting scroll 4.

In the second thrust receiver 113, a groove 113C as a circular groove using the axis X2-X2 as a center is formed on the surface side facing the sphere 20. The reception plate 17 described in the first embodiment is fixed in the groove 113C in an engagement state. Further, the second thrust receiver 113 has a shape bilaterally symmetrical with the first thrust receiver 112. Consequently, the first and second thrust receivers 112 and 113 can be formed as the same parts.

Reference numeral 114 denotes a resin boot as a cylindrical member forming a part of the ball coupling mechanism 111. The resin boot 114 is formed as a cylindrical body using, for example, a resin material having flexibility which can be elastically deformed. A core 115 for regulating deformation in the axial direction is buried in the resin boot 114. The deformation of the resin boot 114 is regulated by the core 115 in directions parallel with the axis X1-X1 and the axis X2-X2 and the resin boot 114 maintains flexibility in directions perpendicular to the axes.

Both ends in the axial direction of the resin boot 114 are fit in boot attachment portions 112A and 113A of the first and second thrust receivers 112 and 113 in a state where the sphere 20 is surrounded from the outside in the radial direction. In this state, the both ends of the resin boot 114 are fastened to the boot attachment portions 112A and 113A by fastening rings 116 and 117. Consequently, the resin boot 114 has the function of suppressing a displacement amount (eccentricity amount) of the second thrust receiver 113 in the eccentricity direction with respect to the first thrust receiver 112 within the dimension δ (orbiting radius) between the axis X1-X1 and the axis X2-X2.

Reference numeral 118 denotes an inner space defined between the first and second thrust receivers 112 and 113 by the cylindrical resin boot 114. The inner space 118 is a lubricant holding space for holding the lubricant such as grease around the sphere 20 and assuring, for example, supply of the lubricant to the space between the guide grooves 17A and 19A of the reception plates 17 and 19 and the sphere 20.

In the embodiment employing such a configuration, in a manner similar to the first embodiment, the thrust load applied to the end plate 4A of the orbiting scroll 4 can be received by the space between the first and second thrust receivers 112 and 113 (reception plates 17 and 19) of the ball coupling mechanism 111 and the sphere 20. The orbiting scroll 4 is prevented from being displaced in the axial direction of the casing 1 or tilting with respect to the fixed scroll 2, and the orbiting motion of the orbiting scroll 4 can be stabilized.

In the ball coupling mechanism 111 in this case, both ends of the resin boot 114 surrounding the sphere 20 from the outside in the radial direction between the first and second thrust receivers 112 and 113 are fixed to the boot attachment portions 112A and 113A of the first and second thrust receivers 112 and 113. The resin boot 114 has a configuration that deformation in the axial direction is regulated by the core 115 and flexibility in the direction perpendicular to the axial direction is maintained. Therefore, for example, displacement (eccentricity) of the second thrust receiver 113 to a position distant from respect to the first thrust receiver 112 over the dimension δ (orbiting radius) can be regulated. By suppressing the rotating motion of the orbiting scroll 4, the so-called rotation preventing effect can be realized.

Between the first and second thrust receivers 112 and 113, the inner space 118 is formed by the resin boot 114 surrounding the sphere 20 from the outside.

Consequently, the lubricant such as grease can be held around the sphere 20 in the inner space 118. The space between the guide grooves 17A and 19A of the reception plates 17 and 19 and the sphere 20 can be held in a lubricating state for a long time.

Moreover, the inner space 118 in this case can be formed as an enclosed space which is cut off from the outside air and the like by the first and second thrust receivers 112 and 113 and the resin boot 114. Consequently, the lubricant in the inner space 118 can be prevented from leaking to the outside more reliably. The lubricant sealed in the inner space 118 can be set to lower viscosity.

Cylindrical guides as guide members are provided on the outside of the resin boot 114. By the cylindrical guides, flexural deformation of the resin boot 114 is regulated from the outside in the radial direction.

Between the first and second thrust receivers, an inner guide member is provided on the inside in the radial direction of the cylindrical member, and an outer guide member is provided on the outside in the radial direction of the cylindrical member.

Figure 11:
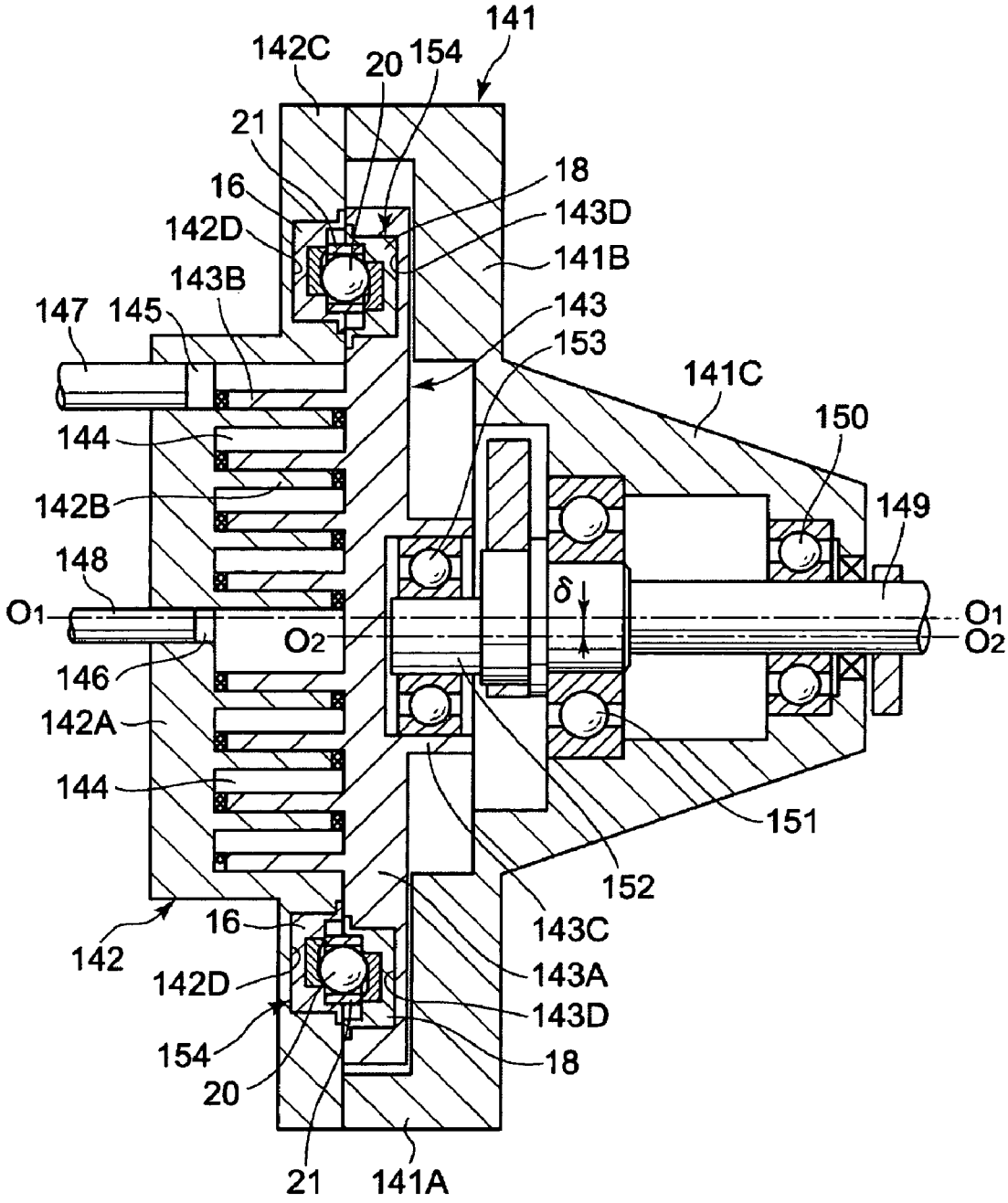
FIG. 11 is a longitudinal sectional view showing a scroll type vacuum pump according to a fifth embodiment.

FIG. 11 shows a fifth embodiment of the present invention. The fifth embodiment is featured in that the ball coupling mechanism is applied to a vacuum pump as a scroll type fluid machine or a compressor of a type of pressing an orbiting scroll against a fixed scroll by back pressure. In the fifth embodiment, the same structural elements as those in the first embodiment are assigned with the same reference numerals, thus description will not be repeated here.

In FIG. 11, reference numeral 141 denotes a casing forming an outer shell of a vacuum pump (scroll type fluid machine). The casing 141 has a configuration similar to that of the casing 1 in the first embodiment. The casing 141 includes a cylindrical portion 141A, an annular bottom portion 141B, and a cylindrical bearing attachment portion 141C. A fixed-side member is constructed by the casing 141 and a fixed scroll 142 which will be described later.

Reference numeral 142 denotes the fixed scroll fixed at the open end of the casing 141 (cylindrical portion 141A). The fixed scroll 142 is constructed in a manner similar to the fixed scroll 2 in the first embodiment and includes an end plate 142A, a spiral wrap portion 142B, and a support portion 142C. The fixed scroll 142 is different from the first embodiment with respect to the point that a ball coupling mechanism 154 is provided between the fixed scroll 142 and an orbiting scroll 143 which will be described later.

The support portion 142C in the fixed scroll 142 has a plurality of (for example, three) attachment recesses 142D for receiving a thrust load in the axial direction applied to the orbiting scroll 143 which will be described later via the ball coupling mechanism 154. The attachment recesses 142D are provided at predetermined intervals in the circumferential direction of the fixed scroll 142.

Reference numeral 143 denotes the orbiting scroll orbitably provided in the casing 141 in a position opposed to the fixed scroll 142 in the axial direction. The orbiting scroll 143 is constructed in a manner similar to the orbiting scroll 4 in the first embodiment and has an end plate 143A, a spiral wrap portion 143B, and a cylindrical boss portion 143C.

In the orbiting scroll 143 in this case, for example, three attachment recesses 143D (only two attachment recesses 143D are shown in FIG. 11) are provided at intervals in the circumferential direction of the orbiting scroll 143 in positions where the attachment recesses 143D face the attachment recesses 142D in the fixed scroll 142. In the attachment recesses 143D, thrust receivers 18 of the ball coupling mechanism 15 which will be described later are fit and attached.

The boss portion 143C of the orbiting scroll 143 is disposed so that an axis O2-O2 as the center is eccentric in the radial direction from the axis O1-O1 as the center of the fixed scroll 2 only by a predetermined dimension δ. The wrap portion 143B of the orbiting scroll 143 is disposed so as to overlap the wrap portion 142B of the fixed scroll 142. A plurality of compression chambers 144, 144, . . . are defined between the wrap portions 142B and 143B.

The orbiting scroll 143 is driven by an electric motor (not shown) or the like via a rotary shaft 149 and an eccentric shaft 152, which will be described later, to perform an orbiting motion on the fixed scroll 142 in a state where rotation of the orbiting scroll 143 is regulated by the ball coupling mechanism 154 which will be described later. That is, the orbiting scroll 143 performs the orbiting motion around the axis O1-O1 of the fixed scroll 142 with an orbiting radius of the amount of the dimension δ.

The compression chamber 144 on the outer diameter side out of the plurality of compression chambers 144 takes gas such as air through an intake port 145 provided on the outer peripheral side of the fixed scroll 142 and compresses the gas in each of the compression chambers 144 with the orbiting motion of the orbiting scroll 143. The compression chamber 144 on the inner diameter side discharges (exhausts) the gas to the outside from a discharge port 146 provided in the center side of the fixed scroll 142.

The intake port 145 is connected to an airtight container (not shown) or the like via a conduct pipe 147. The discharge port 146 is open, for example, to the atmosphere via a pipe 148 or the like. Consequently, the air in the airtight container is discharged to the atmosphere via the conduct pipe 147, the intake port 145, the compression chamber 144, the discharge port 146, and the pipe 148. The inside of the airtight container is maintained in a negative pressure state close to vacuum.

Reference numeral 149 denotes a rotary shaft rotated by an electric motor or the like as a drive source. The rotary shaft 149 is rotatably provided in the bearing attachment portion 141C of the casing 141 via bearings 150 and 151 and the like. To the front end side of the rotary shaft 149 (one side in the axial direction), the boss portion 143C of the orbiting scroll 143 is coupled orbitably via the eccentric bush 152 and the orbit bearing 153.

Reference numeral 152 denotes the eccentric shaft provided at the front end side of the rotary shaft 149. The eccentric shaft 152 is attached to the boss portion 143C of the orbiting scroll 143 via the orbit bearing 153 which will be described later. The eccentric shaft 152 rotates integrally with the rotary shaft 149 and converts the rotation to the orbiting operation of the orbiting scroll 143 via the orbit bearing 153.

Reference numeral 153 denotes the orbit bearing disposed between the boss portion 143C of the orbiting scroll 143 and the eccentric shaft 152. The orbit bearing 153 supports the boss portion 143C of the orbiting scroll 143 so as to orbit with respect to the eccentric shaft 152. The orbit bearing 153 is provided to assure that the orbiting scroll 143 orbits with the orbiting radius (dimension δ) with respect to the axis O1-O1 of the rotary shaft 149.

Reference numerals 154, 154, . . . denote ball coupling mechanisms as rotation preventing mechanisms employed in the embodiment. Like the ball coupling mechanism 15 in the first embodiment, the ball coupling mechanism 154 includes the first and second thrust receivers 16 and 18 (reception plates 17 and 19), the sphere 20, and the cylindrical ring 21.

The ball coupling mechanism 154 is different from that in the first embodiment with respect to the point that it is disposed between the fixed scroll 142 and the orbiting scroll 143. In the ball coupling mechanism 154, the first thrust receiver 16 is fit in the attachment recess 142D in the fixed scroll 142, and the second thrust receiver 18 is fit in the attachment recess 143D in the orbiting scroll 143.

In this case, it is sufficient to provide the ball coupling mechanisms 154 at least in three places at intervals in the circumferential direction in order to receive the thrust load from the orbiting scroll 143. Each set of the ball coupling mechanisms 154 is made of the thrust receivers 16 and 18 and the sphere 20. To prevent rotation of the orbiting scroll 143, it is sufficient to provide sets of the cylindrical rings 21 and the thrust receivers 16 and 18 at least in two places.

In the embodiment employing such a configuration, in the case of using the scroll type fluid machine as a vacuum pump or a compressor of a type of pressing the orbiting scroll against the fixed scroll by back pressure, when a thrust load in the direction of making the orbiting scroll 143 approach the fixed scroll 142 side by the negative pressure generated in the compression chambers 144 is received, the thrust load can be received between the thrust receivers 16 and 18 of the ball coupling mechanism 154 and the sphere 20.

With the configuration, the ball coupling mechanism 154 can prevent the orbiting scroll 143 from being displaced in the axial direction of the fixed scroll 142 or tilting, so that the orbiting motion of the orbiting scroll 143 can be stabilized. Like in the first embodiment, the rotating operation of the orbiting scroll 143 is suppressed, and the so-called rotation preventing effect can be achieved.

In the fifth embodiment, the case of constructing the ball coupling mechanism 154 by the first and second thrust receivers 16 and 18, the sphere 20, and the cylindrical ring 21 has been described. However, the present invention is not limited to the embodiment. For example, any of the ball coupling mechanisms 31, 61, and 111 of the second to fourth embodiments may be provided between the fixed scroll 142 and the orbiting scroll 143.

In the first embodiment, the case of lubricating the cylindrical ring 21 with a lubricant such as grease has been described as an example. However, the present invention is not limited to the case. For example, the cylindrical ring 21 (cylindrical member) may be formed by using a self-lubricative material, an oil-impregnated material, or the like. In this case, it is unnecessary to lubricate the cylindrical member.

In the case of using no lubricant, the flanges 16D and 18D of the thrust receivers 16 and 18 can be eliminated, and the shape of each of the thrust receivers 16 and 18 can be made simpler. The same is applied to the second and third embodiments and the like.

In the first embodiment, the case of constructing the ball coupling mechanism 15 by the first and second thrust receivers 16 and 18 (reception plates 17 and 19), the sphere 20, and the cylindrical ring 21 has been described as an example. However, the invention is not limited to the configuration. For example, a part corresponding to the first thrust receiver 16 may be provided integrally with the seat portion 1D side of the casing 1 and a part corresponding to the second thrust receiver 18 may be provided integrally with the rear side of the orbiting scroll 4.

It is unnecessary to form the reception plates 17 and 19 separately from the first and second thrust receivers 16 and 18. A part corresponding to the reception plate 17 may be provided together with the first thrust receiver 16 integrally with the seat portion 1D side of the casing 1. A part corresponding to the reception plate 19 may be provided together with the second thrust receiver 18 integrally with the rear side of the orbiting scroll 4.

This point is similarly applied to the second to fourth embodiments. In the case of a vacuum pump described in the fifth embodiment, for example, a part corresponding to the first thrust receiver 16 (reception plate 17) may be provided integrally on the fixed scroll 142 side, and a part corresponding to the second thrust receiver 18 (reception plate 19) may be provided integrally on the orbiting scroll 143 side.

Further, in the first embodiment, the scroll type air compressor including the fixed scroll 2 and the orbiting scroll 4 has been described as an example. However, the present invention is not limited to the embodiment. The present invention can be widely applied to a scroll type fluid machine such as a refrigerant compressor.

What is claimed is:

1. A scroll type fluid machine comprising:

a fixed-side member including a cylindrical casing, and a fixed scroll fixed to said casing and having an end plate and a spiral wrap portion extending from said end plate;

an orbiting scroll opposed to said fixed scroll of said fixed-side member, orbitably provided in said casing, having an end plate and a spiral wrap portion extending from said end plate, said wrap portion of said orbiting scroll overlapping said wrap portion of the fixed scroll, thereby defining a plurality of compression chambers; and at least three ball coupling mechanisms provided between said orbiting scroll and said fixed-side member to prevent rotation of said orbiting scroll, and for receiving a thrust load between them, wherein at least two of said ball coupling mechanisms comprises:

a sphere rotatably provided between said fixed-side member and said orbiting scroll for receiving a thrust load applied to said orbiting scroll; and a rotation preventing cylindrical member provided between said fixed-side member and said orbiting scroll so as to surround the sphere from the outside in the radial direction to prevent rotation of said orbiting scroll.

2. The scroll type fluid machine according to claim 1, wherein said cylindrical member makes a rolling contact with said fixed-side member side and said orbiting scroll side.

3. The scroll type fluid machine according to claim 2, wherein an outer periphery side of said cylindrical member makes a rolling contact with said fixed-side member side and said orbiting scroll side, and an inner peripheral side of said cylindrical member is constructed by a cylindrical ring having an inner diameter corresponding to said sphere.

4. The scroll type fluid machine according to claim 2, wherein an outer surface shape of said cylindrical member is a spherical shape.

5. The scroll type fluid machine according to claim 1, wherein at least two ball coupling mechanisms comprises:

a first thrust receiver taking the form of a bottomed cylindrical member provided for said casing in a position opposed to a rear side of said orbiting scroll, whose one side in the axial direction opens to form a cylindrical portion, and whose other side closes to be a bottom portion;

a second thrust receiver taking the form of a bottomed cylindrical member provided on the rear side of the orbiting scroll so as to face the first thrust receiver in the axial direction, whose one side in the axial direction closes to be a bottom portion, and whose the other side, facing the first thrust receiver, opens;

a sphere rotatably provided between the bottom portion side of said first thrust receiver and the bottom portion side of said second thrust receiver for receiving a thrust load to be applied to said orbiting scroll in cooperation with the first and second thrust receivers; and a rotation preventing cylindrical member positioned between said first and second thrust receivers, provided so as to surround said sphere from outside in the radial direction, and preventing rotation of said orbiting scroll by making a rolling contact with an inner peripheral side of a cylindrical portion in said first thrust receiver and an inner peripheral side of a cylindrical portion in said second thrust receiver.

6. The scroll type fluid machine according to claim 5, wherein said cylindrical member is a cylindrical ring whose outer peripheral side makes a rolling contact with the fixed-side member side and the orbiting scroll side, and whose inner peripheral side has an inner diameter corresponding to said sphere.

7. The scroll type fluid machine according to claim 5, wherein an outer shape of said cylindrical member is a spherical surface shape.

8. The scroll type fluid machine according to claim 5, wherein each of the first and second thrust receivers has a circular guide groove in its bottom portion in order to guide said sphere rotatably in accordance with orbiting motion of said orbiting scroll.

9. The scroll type fluid machine according to claim 5, wherein one of surfaces of a cylinder portion in each of the first and second thrust receivers and said cylindrical member, the surfaces facing each other in the radial direction and making a rolling contact with each other, is formed in a spherical shape, and the other surface is formed as a taper surface of a conic shape.

10. The scroll type fluid machine according to claim 5, further comprising sealing means provided between the cylindrical portions which face each other and are open in said first and second thrust receivers, wherein said sealing means seals a lubricant for holding said sphere in a lubricating state and leaking to the outside between the thrust receivers.

11. The scroll type fluid machine according to claim 10, wherein said sealing means is a disc-shaped annular flat plate sandwiched between the open ends of the cylindrical portions in the first and second thrust receivers.

12. The scroll type fluid machine according to claim 11, wherein said disc-shaped annular flat plate is provided on an outer periphery side of the cylindrical member so as to move integrally with said cylindrical member.

13. The scroll type fluid machine according to claim 1, wherein at least two ball coupling mechanisms comprises:

a first thrust receiver taking the form of a bottomed cylindrical member provided for said casing in a position opposed to a rear side of said orbiting scroll, whose one side in the axial direction opens to form a cylindrical portion, and whose other side closes to be a bottom portion;

a second thrust receiver taking the form of a bottomed cylindrical member provided on the rear side of the orbiting scroll so as to face the first thrust receiver in the axial direction, whose one side in the axial direction closes to be a bottom portion, and whose the other side, facing the first thrust receiver, opens;

a sphere rotatably provided between the bottom portion side of said first thrust receiver and the bottom portion side of said second thrust receiver for receiving a thrust load to be applied to said orbiting scroll in cooperation with the first and second thrust receivers; and a rotation preventing cylindrical member positioned between said first and second thrust receivers, provided so as to surround said sphere from outside in the radial direction, and preventing rotation of the orbiting scroll by making a rolling contact with an outer peripheral side of a cylindrical portion in said first thrust receiver and an outer peripheral side of a cylindrical portion in said second thrust receiver.

14. The scroll type fluid machine according to claim 13, wherein said cylindrical member is a cylindrical ring formed with an inner diameter larger than an outer diameter of said each of cylindrical portions only by a predetermined dimension so that an inner peripheral side makes a rolling contact with the outer peripheral side of the cylindrical portion of said first thrust receiver and the outer peripheral side of the cylindrical portion of said second thrust receiver.

15. The scroll type fluid machine according to claim 13, wherein each of said first and second thrust receivers has a circular guide groove in its bottom portion in order to guide said sphere rotatably in accordance with an orbiting motion of said orbiting scroll.

16. The scroll type fluid machine according to claim 1, wherein at least two ball coupling mechanisms comprises:

a sphere rotatably provided between the casing side and an orbiting scroll side and receiving a thrust load applied to the orbiting scroll; and a rotation preventing cylindrical member whose both ends in the axial direction are fixed to said casing side and said orbiting scroll side in a state where said sphere is surrounded from outside in the radial direction, and whose deformation in the axial direction is regulated while deformation in the radial direction is permitted, thereby preventing rotation of said orbiting scroll.

17. The scroll type fluid machine according to claim 16, wherein said cylindrical member is made of a synthetic resin material.

18. A scroll type fluid machine comprising:

a cylindrical casing;

a fixed scroll fixed to said casing and having an end plate and a spiral wrap portion extending from said end plate;

an orbiting scroll opposed to said fixed scroll, orbitably provided in said casing, having an end plate and a spiral wrap portion extending from said end plate, said wrap portion of said orbiting scroll overlapping said wrap portion of the fixed scroll, thereby defining a plurality of compression chambers; and at least three ball coupling mechanisms provided between the orbiting scroll and said casing to prevent rotation of the orbiting scroll, and receiving a thrust load between them, wherein at least two of said ball coupling mechanisms comprises:

a first thrust receiver taking the form of a bottomed cylindrical member provided for said casing in a position opposed to a rear side of said orbiting scroll, whose one side in the axial direction opens to form a cylindrical portion, and whose other side closes to be a bottom portion;

a second thrust receiver taking the form of a bottomed cylindrical member provided on the rear side of the orbiting scroll so as to face the first thrust receiver in the axial direction, whose one side in the axial direction closes to be a bottom portion, and whose the other side, facing the first thrust receiver, opens;

a sphere rotatably provided between a bottom portion side of said first thrust receiver and a bottom portion side of said second thrust receiver, for receiving a thrust load applied to said orbiting scroll in cooperation with said first and second thrust receivers; and a rotation preventing cylindrical member positioned between said first and second thrust receivers, provided so as to surround said sphere from outside in radial direction, and preventing rotation of said orbiting scroll by making a rolling contact with an inner peripheral side of a cylindrical portion of said first thrust receiver and an inner peripheral side of a cylindrical portion of said second thrust receiver.

19. The scroll type fluid machine according to claim 18, wherein said cylindrical member is a cylindrical ring whose outer peripheral side makes a rolling contact with said fixed-side member side and said orbiting scroll side, and whose inner peripheral side has an inner diameter corresponding to said sphere.

20. The scroll type fluid machine according to claim 18, wherein each of said first and second thrust receivers has a circular guide groove in its bottom portion in order to guide said sphere rotatably in accordance with an orbiting motion of said orbiting scroll.

* * * * *